US009080404B2

(12) United States Patent
Kalb et al.

(10) Patent No.: US 9,080,404 B2
(45) **Date of Patent: *Jul. 14, 2015**

(54) METHOD AND SYSTEM FOR INTERVENTIONLESS HYDRAULIC SETTING OF EQUIPMENT WHEN PERFORMING SUBTERRANEAN OPERATIONS

(71) Applicant: Dril-Quip, Inc., Houston, TX (US)

(72) Inventors: Frank D. Kalb, Cypress, TX (US); Andrew J. Webber, Cypress, TX (US); John M. Yokley, Kingwood, TX (US)

(73) Assignee: Dril-Quip, Inc., Houston, TX (US)

( * ) Notice: Subject to any disclaimer, the term of this patent is extended or adjusted under 35 U.S.C. 154(b) by 255 days.

This patent is subject to a terminal disclaimer.

(21) Appl. No.: 13/691,014

(22) Filed: Nov. 30, 2012

(65) Prior Publication Data

US 2014/0150417 A1 Jun. 5, 2014

(51) Int. Cl.
*E21B 23/04* (2006.01)

(52) U.S. Cl.
CPC ..... *E21B 23/04* (2013.01)

(58) Field of Classification Search
CPC ..... E21B 23/00; E21B 23/01; E21B 23/04
USPC ..... 166/373, 374, 375
See application file for complete search history.

(56) References Cited

U.S. PATENT DOCUMENTS

| | | | | |
|---|---|---|---|---|
| 3,964,305 | A | | 6/1976 | Wray et al. |
| 4,113,012 | A | | 9/1978 | Evans et al. |
| 4,285,400 | A | | 8/1981 | Mullins |
| 4,421,174 | A | | 12/1983 | McStravick |
| 4,444,268 | A | | 4/1984 | Barrington |
| 4,448,254 | A | | 5/1984 | Barrington |
| 4,537,258 | A | * | 8/1985 | Beck ..... 166/374 |
| 4,595,060 | A | | 6/1986 | Beck |
| 4,664,196 | A | | 5/1987 | Manke |
| 4,665,991 | A | | 5/1987 | Manke |
| 4,766,960 | A | | 8/1988 | Williamson, Jr. |
| 4,791,991 | A | | 12/1988 | Morris et al. |
| 5,050,681 | A | | 9/1991 | Skinner |
| 5,209,303 | A | | 5/1993 | Barrington |
| 5,564,501 | A | | 10/1996 | Strattan |
| 6,321,847 | B1 | | 11/2001 | Brown |

* cited by examiner

*Primary Examiner* — Brad Harcourt
(74) *Attorney, Agent, or Firm* — Baker Botts L.L.P.

(57) ABSTRACT

Interventionless setting assemblies and associated methods are disclosed. A method of setting downhole equipment comprises applying a pressure to a compensating volume and providing a working volume, wherein the working volume is separated from the compensating volume by one or more hydraulic control devices. A pressure is applied to the working volume in response to the pressure applied to the compensating volume. The pressure applied to the compensating volume is then reduced and the pressure applied to the working volume is captured by maintaining the pressure applied to the working volume when the pressure applied to the compensating volume is reduced. The captured pressure in the working volume is applied to set downhole equipment.

20 Claims, 11 Drawing Sheets

100

128
126
130
105

306
308
310
303
314
312
318
315
318
316
300

METHOD AND SYSTEM FOR INTERVENTIONLESS HYDRAULIC SETTING OF EQUIPMENT WHEN PERFORMING SUBTERRANEAN OPERATIONS

BACKGROUND

The present invention relates generally to setting of downhole equipment and, more particularly, to interventionless setting assemblies and associated methods.

Hydrocarbons, such as oil and gas, are commonly obtained from subterranean formations. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. Controlling the operation of downhole equipment that may be used at each step is an important aspect of performing subterranean operations.

Downhole equipment includes any equipment used downhole to perform subterranean operations. For instance, downhole equipment may include, but is not limited to, equipment used to set wellheads, liner hangers, completion equipment, and/or intervention equipment.

In some instances, mechanical manipulation may be used to control operation of the downhole equipment. Specifically, a setting tool may be lowered into the wellbore on a work string to manipulate downhole equipment to set the device. Alternatively, the setting tool may be lowered downhole on the work string as part of a downhole tool and may be retained therein or retrieved. The term "set(ting)" a device as used herein refers to manipulating a device so that it goes from a first mode of operation to a second mode of operation. Traditional methods of mechanical manipulation of downhole equipment consume precious rig time rendering them undesirable.

In certain other instances, setting pistons (or hydraulic pistons) may be used to set downhole equipment. Specifically, setting pistons may be provided downhole independently (e.g., a setting tool) or as part of downhole equipment (e.g., internal pistons in a hydraulically set packer). However, typically the hydraulic pistons are source referenced in that pressure can be applied to and relieved from the same location in the system. Specifically, the system is typically pressure balanced at the time pressure is applied to the system. This pressure balance prohibits the ability to build a pressure differential and displace volumes, limiting the system's ability to set downhole equipment.

It is therefore desirable to develop methods and systems to more efficiently manipulate downhole equipment.

BRIEF DESCRIPTION OF THE DRAWINGS

Some specific exemplary embodiments of the disclosure may be understood by referring, in part, to the following description and the accompanying drawings.

Figure 1A:
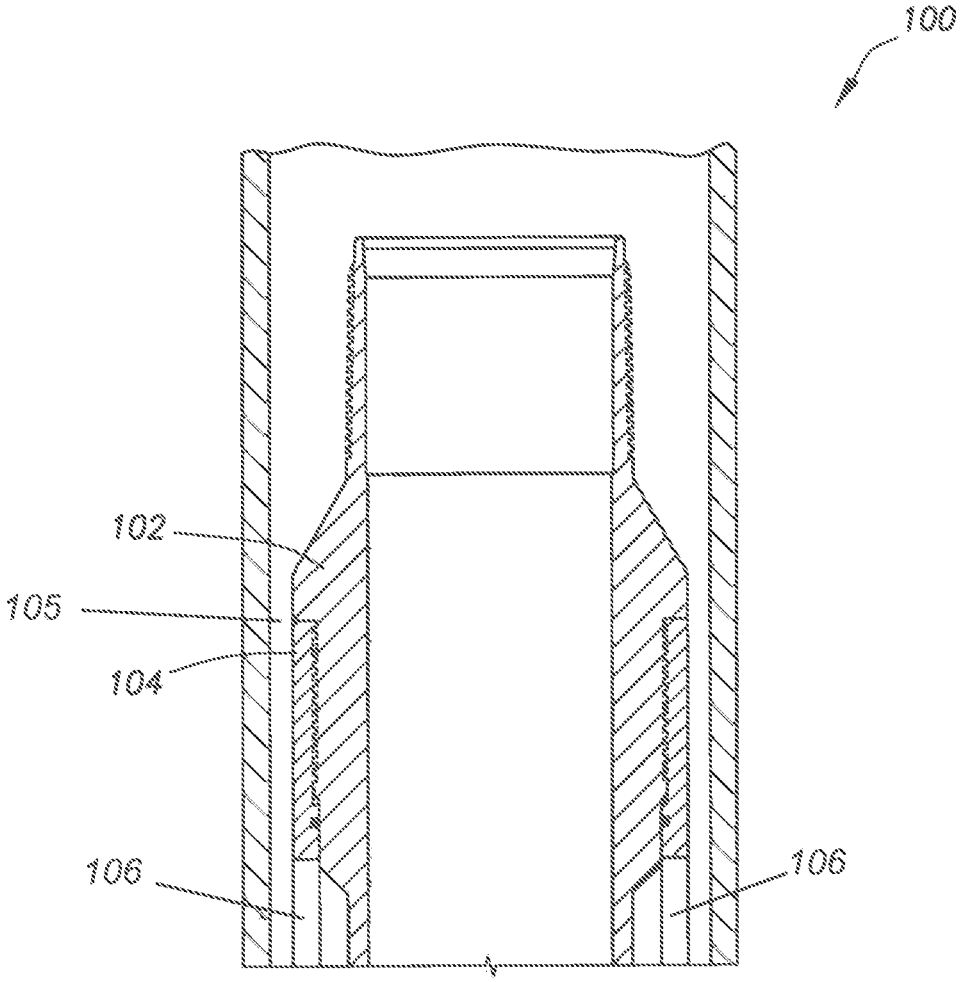
FIGS. 1A-1E depict a cross-sectional view of an Interventionless Hydraulic Setting System ("IHSS") in accordance with an illustrative embodiment of the present disclosure as it extends downhole.
Figure 1B:
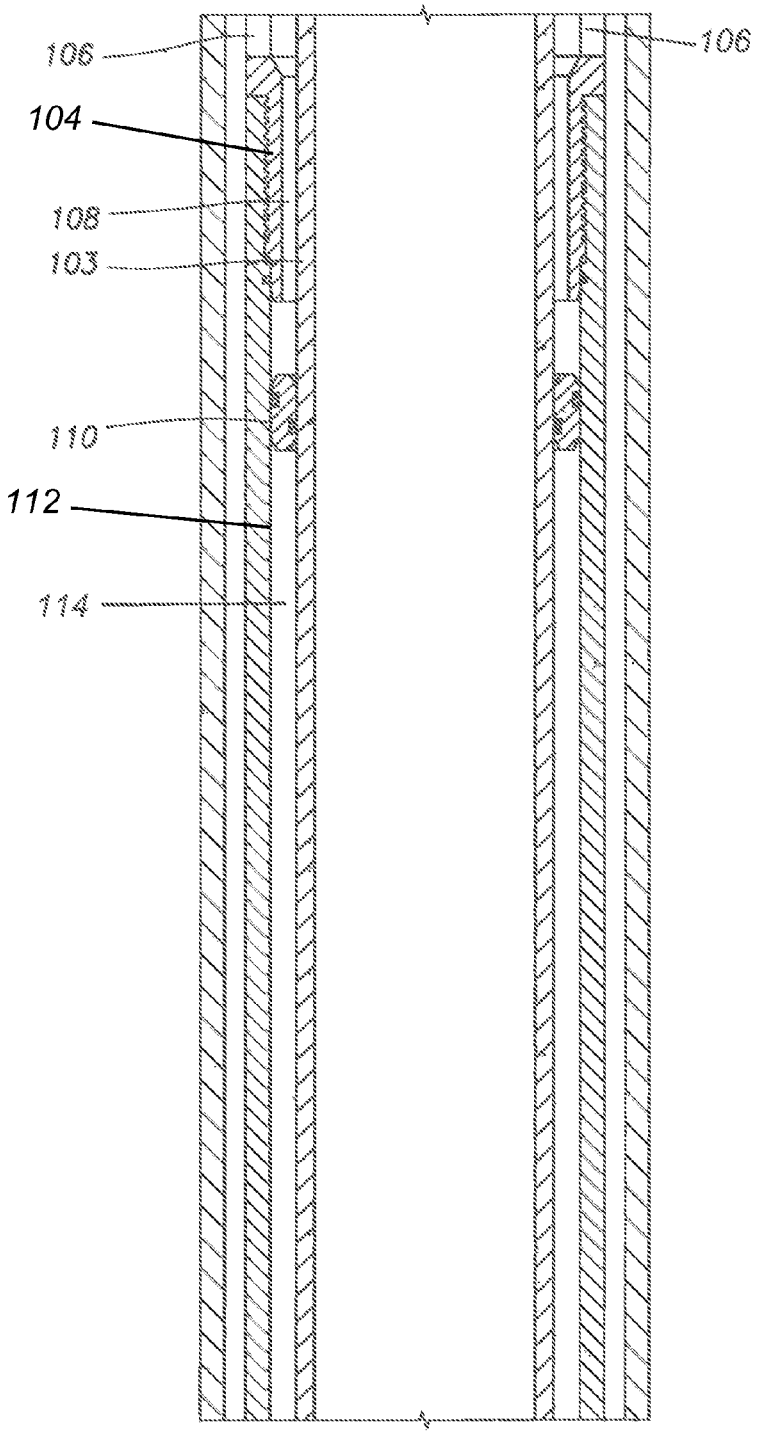
Figure 1C:
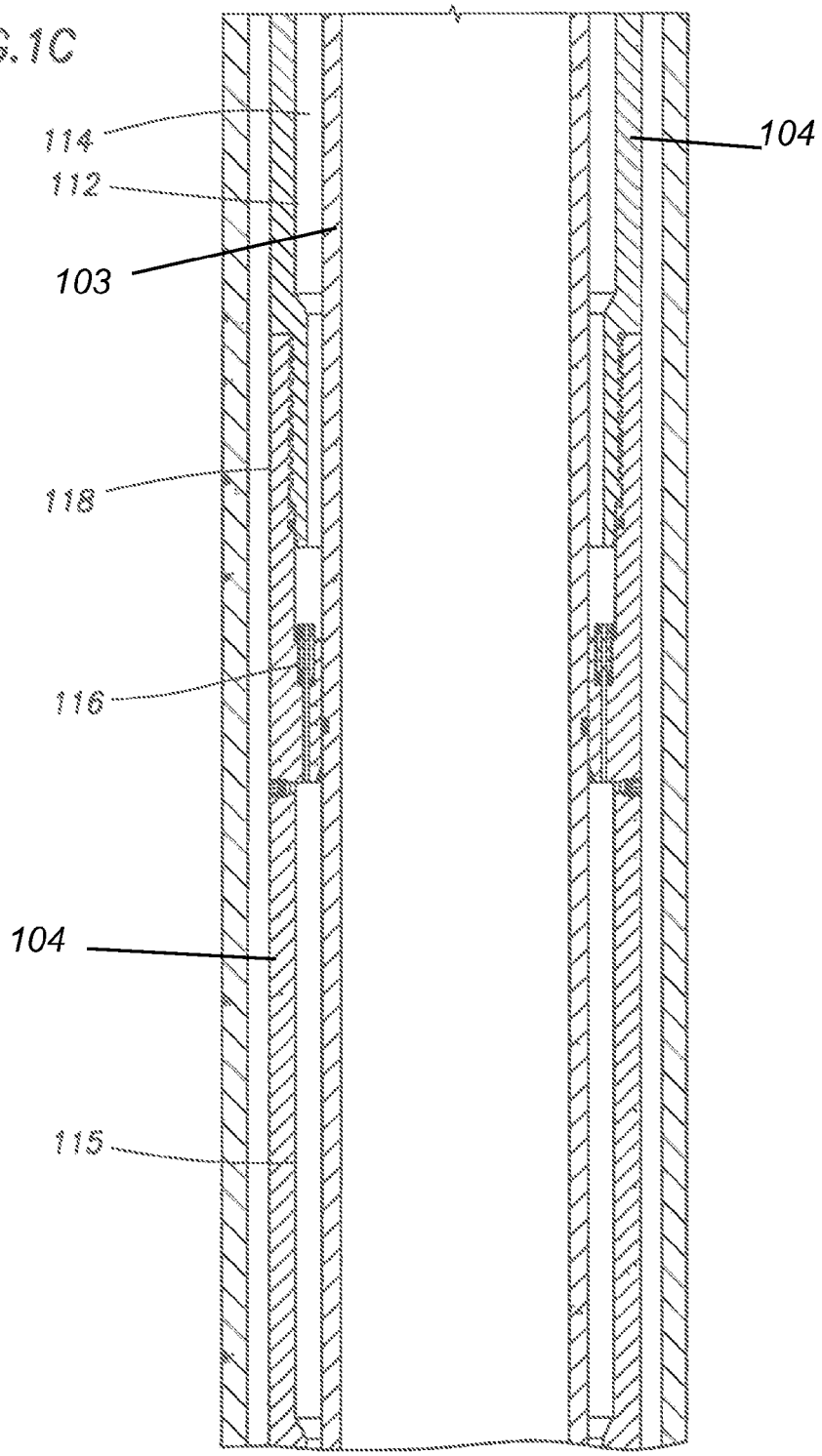
Figure 1D:
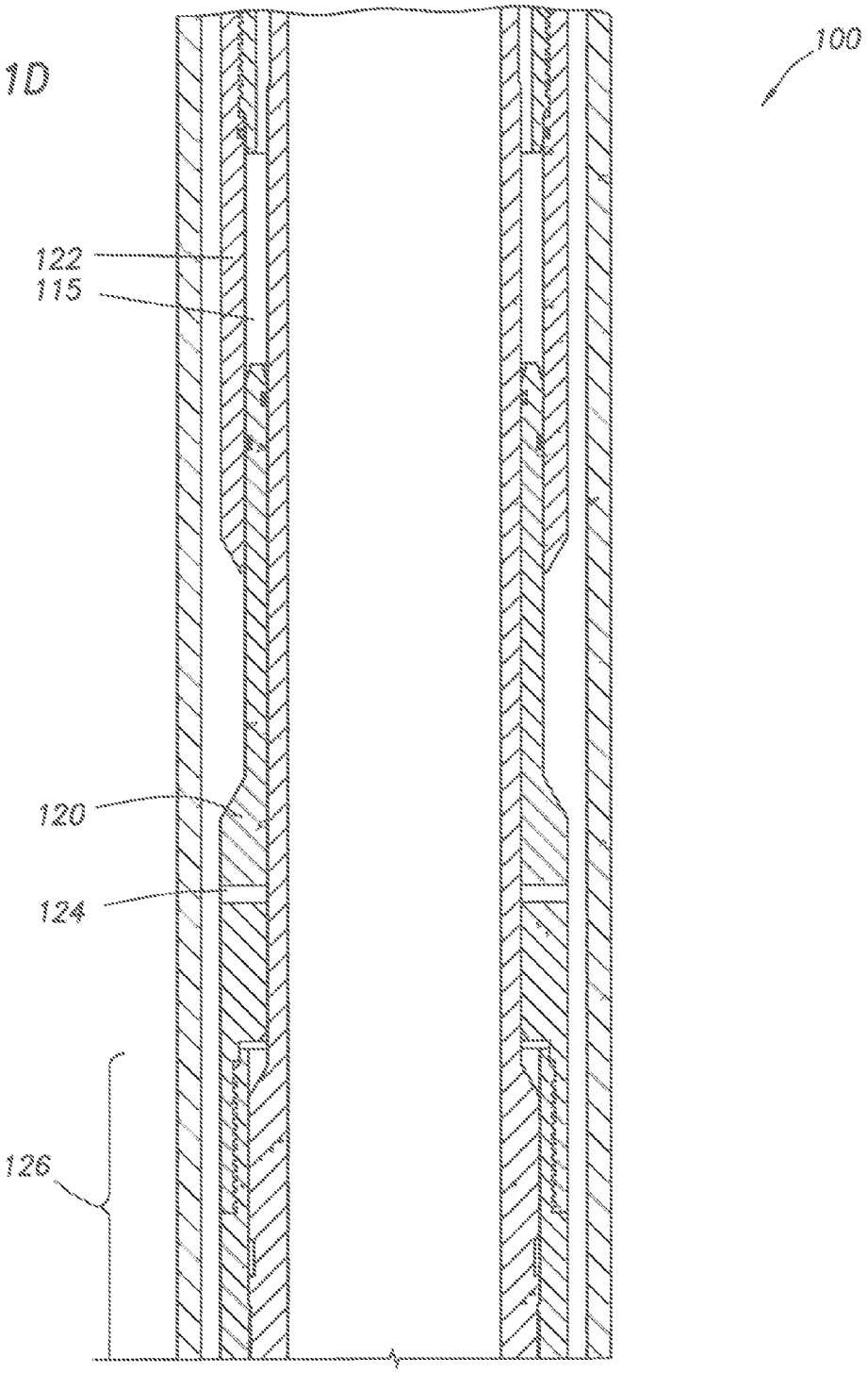
Figure 1E:
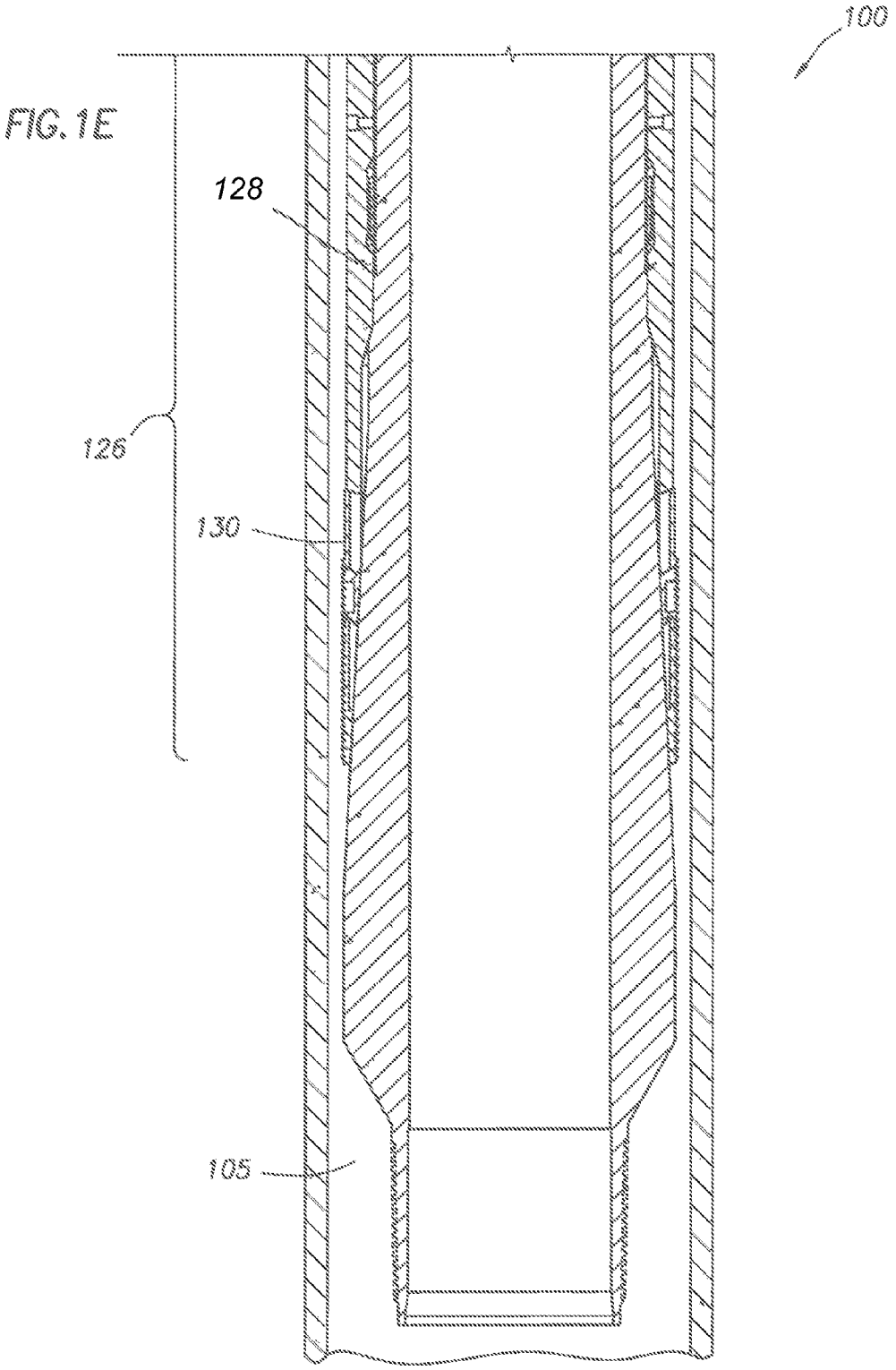

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates generally to the setting of downhole equipment and, more particularly, to interventionless setting assemblies and associated methods.

The terms "couple" or "couples" as used herein are intended to mean either an indirect or direct connection. Thus, if a first device couples to a second device, that connection may be through a direct connection, or through an indirect mechanical or electrical connection via other devices and connections. Similarly, the term "fluidically coupled" as used herein is intended to mean that there is either a direct or an indirect fluid flow path between two components.

The present application discloses a method and system for delivering a pressure charge to a setting piston on a delayed basis. Specifically, a hydraulic volume may be pre-filled with a compressible fluid. The compressible fluid may be any fluid having a low Bulk Modulus, such as, for example, silicone oil. The term "Bulk Modulus" of a substance as used herein refers to the substance's resistance to uniform compression as indicated by the ratio of the infinitesimal pressure increase to the resulting relative decrease of the volume of the substance. As would be appreciated by those of ordinary skill in the art, having the benefit of the present disclosure, silicone oil is mentioned as an illustrative example only and a number of other fluids may be used without departing from the scope of the present disclosure. Specifically, any fluid may be used by adjusting the size of the setting device (discussed below) in proportion to the fluid's Bulk Modulus. Moreover, in certain implementations, the different chambers (e.g., compensating volume and working volume) may contain different compressible fluids without departing from the scope of the present disclosure.

The hydraulic volume may be pressure-filled by a pressure compensating volume and held in place by a hydraulic control device. In certain implementations, the pressure compensating volume may be pressurized from the application of rig pump pressure. Although the illustrative embodiments are discussed in conjunction with utilizing rig pump pressure, the present disclosure is not limited to this specific embodiment. For instance, another device may be used to apply pressure. Moreover, in certain implementations, a differential pressure may be applied by circulating fluids having differing weights which can create different corresponding hydrostatic pressures downhole.

Once the rig pump pressure is released, the compensating volume may substantially instantaneously respond to the lack of pump pressure, creating a differential pressure across a hydraulic control device. This trapped pressure may then be used to perform work on a piston body to set any number of downhole devices. The method and system disclosed will now be discussed in further detail in conjunction with the illustrative embodiments of FIGS. 1 and 3.

Illustrative embodiments of the present invention are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be used with any wellhead system. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

FIGS. 1A-1E depict an Interventionless Hydraulic Setting System ("IHSS") in accordance with an illustrative embodiment of the present disclosure denoted generally with reference numeral 100 as it extends downhole.

In this illustrative embodiment, the IHSS 100 includes a bottom sub 102 coupled to a hydraulic tubing 103. A communication port housing 104 is coupled to and extends along an external surface of the bottom sub 102 and the hydraulic tubing 103. The communication port housing 104 forms an annular space 108 around the bottom sub 102 and the hydraulic tubing 103 and includes a charge port 106 that provides a path for fluid flow into that annular space 108. A floating piston 110 is provided in the annular space 108 and separates the charge port 106 from a compensating volume 112. The compensating volume 112 may be filled with a compressible fluid 114. The compensating volume 112 may in turn be separated from a working volume 115 in the annular space extending along the outer circumference of the hydraulic tubing 103. One or more hydraulic control devices 116 may be provided in a first hydraulic housing 118 between the compensating volume 112 and the working volume 115. The hydraulic devices 116 may operate to regulate fluid flow from the compensating volume 112 to the working volume 115 and vice versa. The term "hydraulic control device" as used herein refers to any device that may be used to regulate fluid flow from one volume or chamber to another. For instance, the term "hydraulic control device" may include, but is not limited to, check valves, restrictors or a combination thereof.

The working volume 115 extends downhole along the outer surface of the bottom sub 102 and the hydraulic tubing 103 between the bottom sub 102/hydraulic tubing 103 and the communication port housing 104 up to a distal end of the bottom sub 102. The distal end of the bottom sub 102 refers to the end of the bottom sub 102 which is located proximate to the downhole equipment to be manipulated. At the distal end, a hydraulic piston 120 is provided. The hydraulic piston 120 extends from a second hydraulic housing 122. One end of the hydraulic piston 120 interfaces with the working volume 115. Accordingly, the working volume 115 may apply pressure to the hydraulic piston 120 and the applied pressure may move the hydraulic piston between a first position and a second position. One or more vents 124 may also be provided to prevent pressure lock and allow fluid displacement in the system.

The hydraulic piston 120 may be used to set downhole equipment as it moves in response to changes in pressure in the working volume 115 between a first position and a second position. In the illustrative embodiment of FIG. 1, the downhole equipment is a hold down body 126. In the illustrative embodiment of FIG. 1, the hold down body 126 includes a pusher sleeve 128 having an anti-backlash system to prevent movement at one end and a hold down slip 130 at the opposite end. Although a hold down body 126 is depicted in the illustrative embodiment of FIG. 1, it would be appreciated that the methods and systems disclosed herein are not limited to manipulating hold down bodies and can be used in conjunction with other downhole equipment without departing from the scope of the present disclosure.

Figure 2:
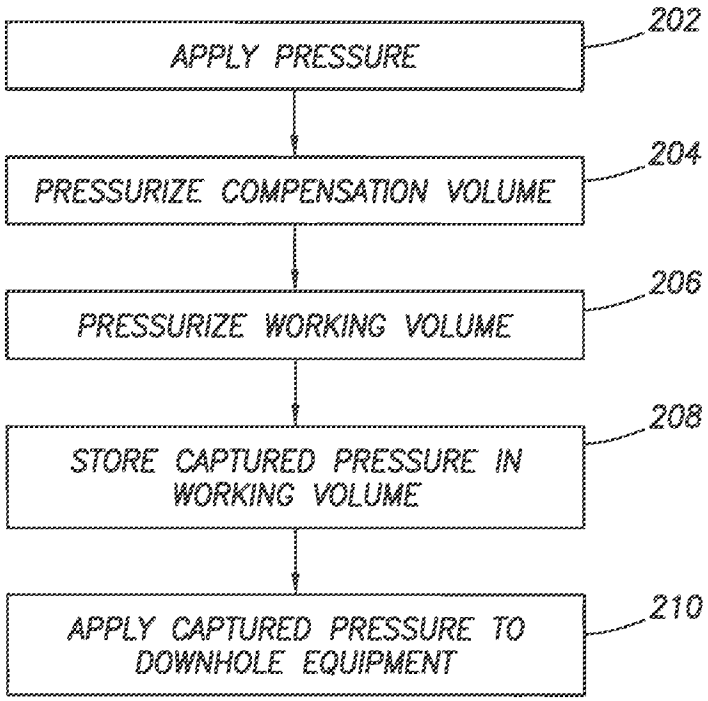
FIG. 2 depicts illustrative method steps associated with a setting cycle using the IHSS of FIG. 1.
Figure 3A:
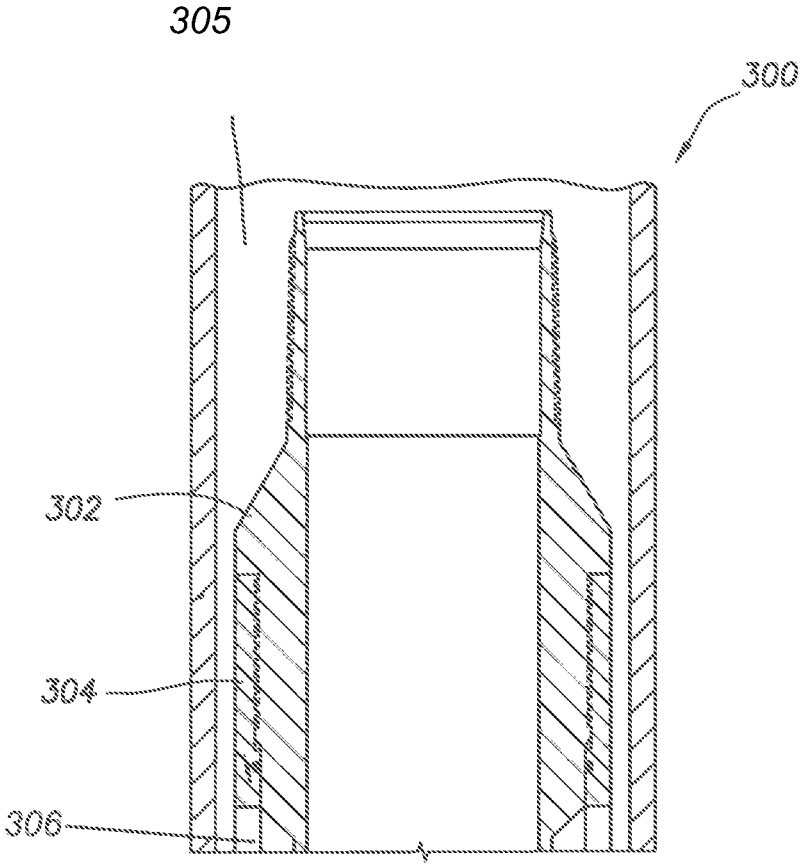
FIGS. 3A-3D depict a cross-sectional view of an IHSS in accordance with another illustrative embodiment of the present disclosure as it extends downhole.
Figure 3B:
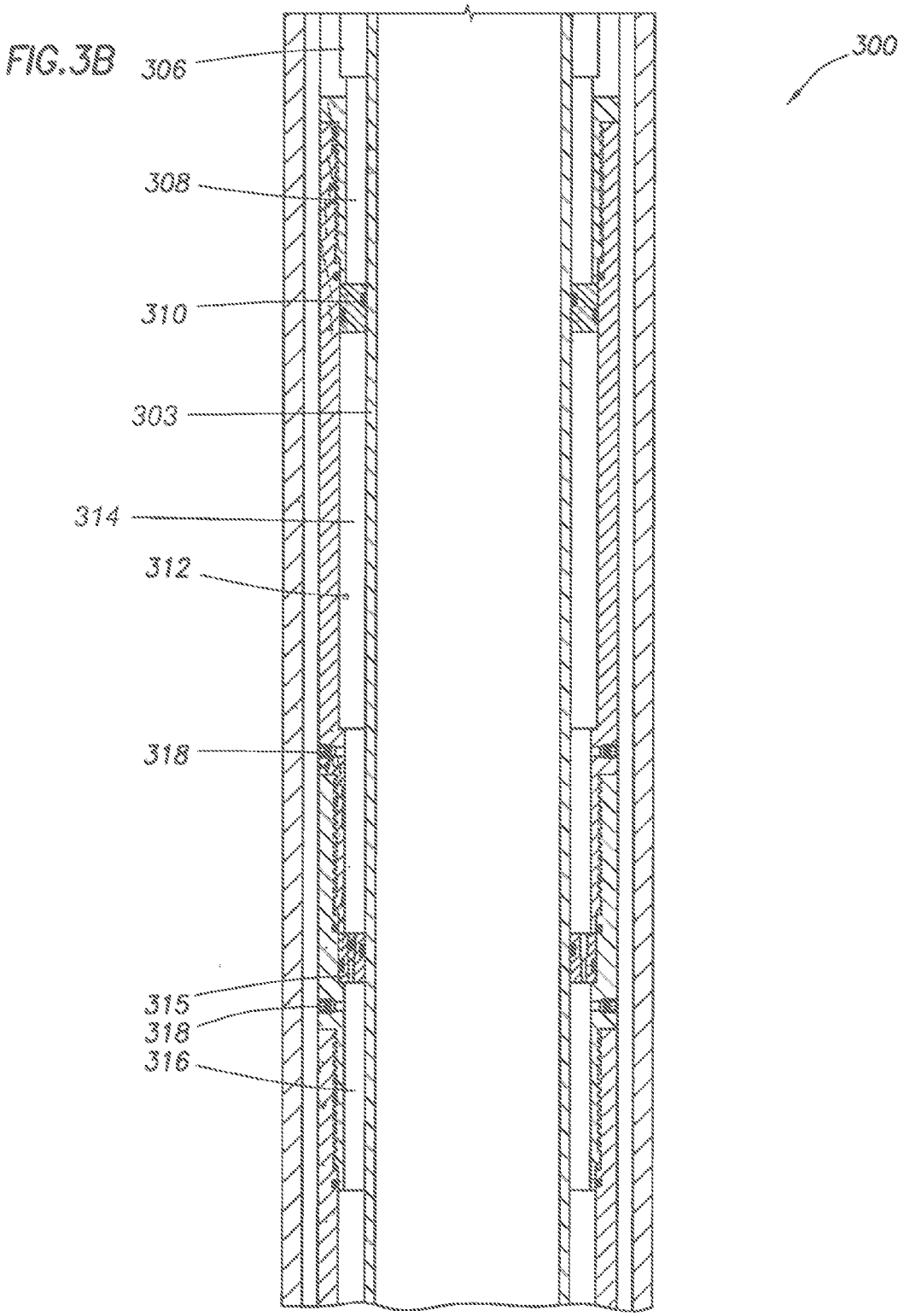
Figure 3C:
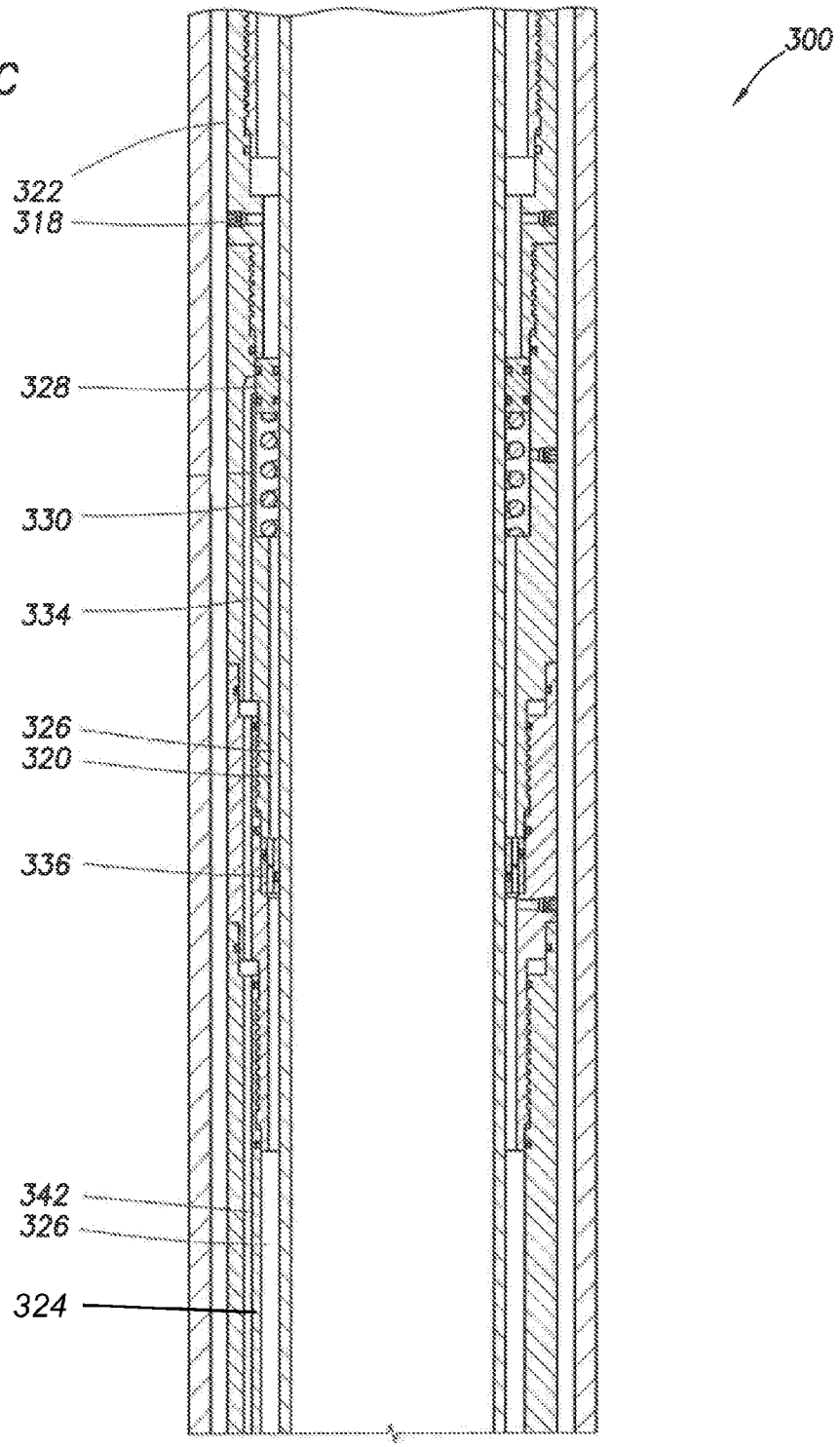
Figure 3D:
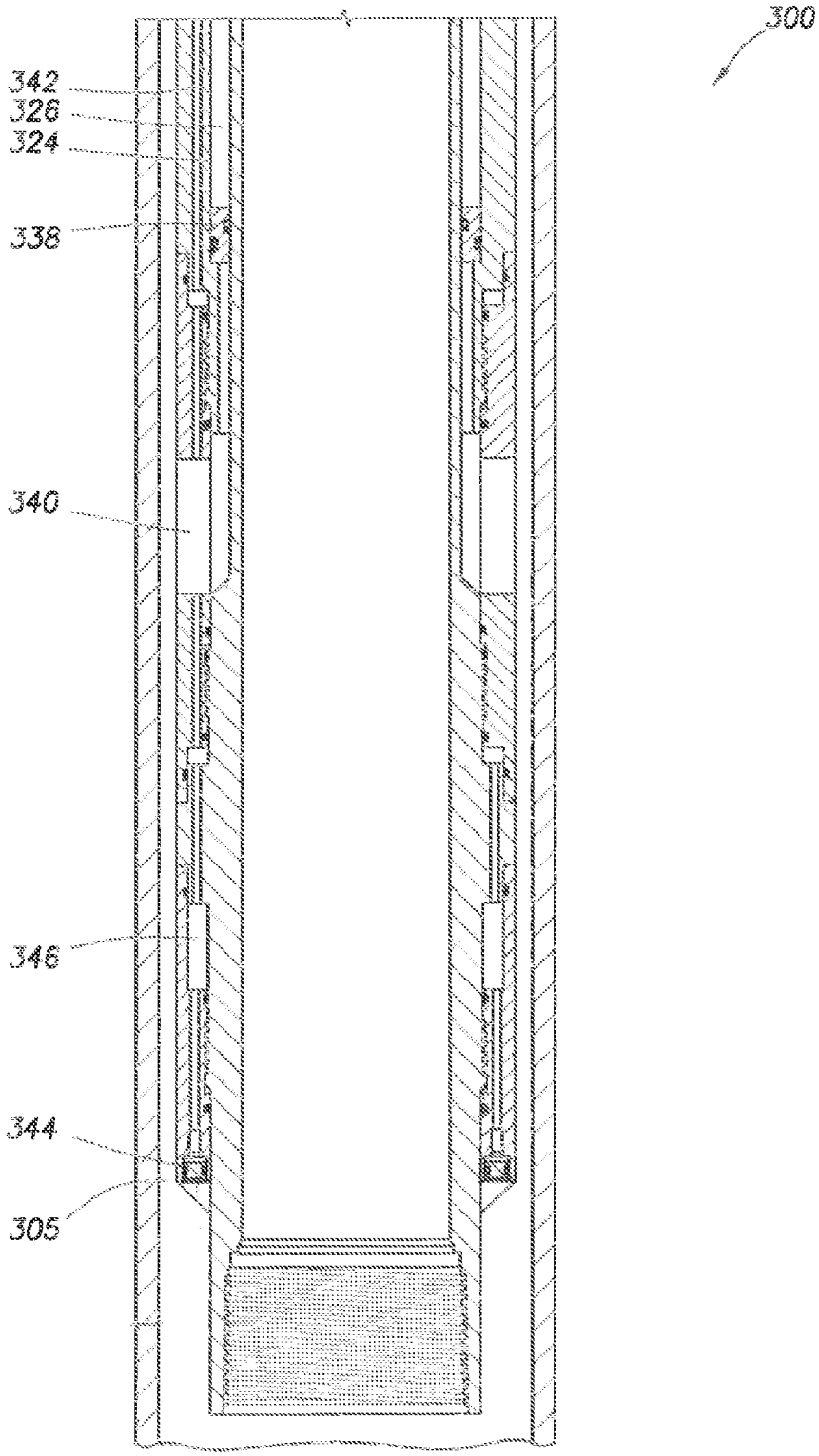

Operation of the IHSS 100 in accordance with an illustrative embodiment will now be discussed in conjunction with FIG. 2. FIG. 2 depicts illustrative method steps associated with a setting cycle using the IHSS 100. Although a number of steps are depicted in FIG. 2, as would be appreciated by those of ordinary skill in the art, having the benefit of the present disclosure, one or more of the recited steps may be eliminated or modified without departing from the scope of the present disclosure. Multiple setting cycles may be implemented as desired using the methods and systems disclosed herein.

First, at step 202, annular pressure may be applied to the system. A rig pump (not shown) or other suitable devices or methods known to those of ordinary skill in the art, having the benefit of the present disclosure, may be used to deliver a fluid through the annulus 105 between the hydraulic tubing 102 and a casing or the wellbore wall if the wellbore is not cased. Although the illustrative embodiments of FIGS. 1 and 3 are generally described in conjunction with applying annular pressure, the methods and systems disclosed herein may also be implemented by applying pressure through the hydraulic tubing 103 instead of applying an annular pressure.

The fluid delivered may be any suitable fluid, including, but not limited to, any completion fluid such as, for example, completion mud or slurry, cement, gas, or completion brine. As fluid is directed into the annulus 105 it generates hydraulic pressure in the system. Specifically, a portion of the fluid may be directed into the charge port 106 of the IHSS 100, applying pressure onto the floating piston 110. As pressure is applied to the floating piston 110, the floating piston 110 moves into its contracted position and pressurizes the compensating volume 112 of the IHSS 100 at step 204.

As the compensating volume 112 is pressurized, it will pressurize the working volume 115 at step 206. Specifically, the compressible fluid 114 flows from the compensating volume 112 into the working volume 115 through one or more hydraulic control devices 116 in response to the increased pressure applied to the floating piston 110. The flow of the compressible fluid 114 into the working volume 115 increases the pressure of the working volume 115. At this point, the pressure of the IHSS 100, the annulus 105 and the hydraulic tubing 103 is balanced.

Next, at step 208, the pressure previously applied to the working volume 115 is captured therein as the pressure in the rest of the system dissipates. Specifically, as the pressure from the rig pump is reduced, the floating piston 110 moves from its contracted position to a relaxed position. In the relaxed position, the compensating volume is substantially pressure balanced with the annular pressure, which may in turn be directly related to the rig pressure. As the pressure of the compensating volume 112 is reduced in response to the reduction in the annular pressure, a pressure differential develops between the compensating volume 112 and the working volume 115. In certain implementations the hydraulic control devices 116 may include one or more check valves. In this implementation, the pressure differential causes the check valves to move onto their corresponding seats and substantially instantaneously seals the working volume 115 from the compensating volume 112. Once the check valves have sealed the working volume 115 from the compensating volume 112, the captured pressure is stored in the working volume 115.

At step 210, the captured pressure in the working volume 115 may be applied to downhole equipment, such as, for example, a hold down body 126. As the rig pump pressure is bled, a pressure differential develops between the pressure in the annulus 105 (or the hydraulic tubing 103) and the working volume 115 pressure. As a result of this pressure differential across the hydraulic piston 120, a working load is developed onto the hold down body 126.

The rate at which pressure differential is developed at the hydraulic piston 120 depends on the rate of dissipation of rig pump pressure. For instance, if the rig pump pressure is dissipated in a manner analogous to a step function, a hammer load is applied to the hydraulic piston 120 to set the hold down body 126. In contrast, if the rig pump pressure is dissipated slowly over time, the load is delivered to the hydraulic piston 120 more smoothly. Such smooth delivery of the load may be appropriate, for example, for use in setting elastomeric and metal-to-metal packers.

In certain implementations, the hydraulic control devices 116 may include one or more hydraulic restrictors. The hydraulic restrictor may slowly bleed the pressure from the working volume 115 back to the compensating volume 112 over a certain time duration. The hydraulic restrictors may be adjusted as desired to achieve a predetermined time duration for the pressure transfer. The hydraulic restrictors may be used to ensure that the stored energy does not remain in the system long term. Alternatively, the hydraulic restrictors may be eliminated or the hydraulic control devices 116 may include a selective check valve (e.g., thermal relief valve) when it is desirable to retain the hydraulic pressure in the system. When a hydraulic restrictor is utilized, the IHSS 100 may be used several times to set downhole equipment so long as the compensating volume 112 has a sufficiently preplanned reservoir to allow for multiple actuations. After the initially captured pressure in the working volume 115 is applied to downhole equipment, the rig pump may once again apply annular pressure (or pressure through the tubing) and repeat the setting operation in the same manner.

As the hydraulic piston 120 coupled to the working volume 115 is displaced to manipulate downhole equipment, the pressure in the working volume 115 reduces. Once the initial displacement of the hydraulic piston 120 has been accommodated, additional cycling of the system may be used to deliver more pressure, and thus, more force, as the hydraulic piston 120 displacement has now been minimized. Accordingly, a first setting cycle of the IHSS 100 may displace the hydraulic piston 120 with some residual pressure in the working volume 115. As previously stated, a subsequent, second setting cycle may deliver a maximum amount of pressure and force with minimal displacement, ensuring a complete setting of downhole equipment.

FIGS. 3A-3D depict an IHSS 300 in accordance with another illustrative embodiment of the present disclosure. As discussed in more detail below, in this embodiment, the IHSS 300 may provide a delayed delivery of pressure by bleeding the working volume pressure to move a shifting sleeve that selectively opens and closes a port that leads to the stored pressure.

In this illustrative embodiment, the IHSS 300 includes a bottom sub 302 coupled to a hydraulic tubing 303. A communication port housing 304 is coupled to and extends along an external surface of the bottom sub 302 and the hydraulic tubing 303. The communication port housing 304 forms an annular space 308 around the bottom sub 302 and the hydraulic tubing 303 and includes a first charge port 306 that provides a path for fluid flow into that annular space 308. A first floating piston 310 is provided in the annular space 308 and separates the first charge port 306 from a first compensating volume 312.

The first compensating volume 312 may be filled with a compressible fluid 314. The first compensating volume 312 may in turn be separated from a first working volume 316 in the annular space extending along the outer circumference of the bottom assembly 302 and the hydraulic tubing 303. One or more hydraulic control devices 315 may be provided between the first compensating volume 312 and the first working volume 316. The hydraulic devices 315 may operate to regulate fluid flow from the first compensating volume 312 to the first working volume 316 and vice versa. The term "hydraulic control device" as used herein refers to any device that may be used to regulate fluid flow from one volume or chamber to another. For instance, the term "hydraulic control device" includes, but is not limited to, check valves, restrictors or a combination thereof. One or more plugged fill ports 318 may be provided to facilitate filling the first compensating volume 312 and the first working volume 316 with a compressible fluid 314. The first working volume 316 extends downhole along the outer surface of the bottom sub 302/hydraulic tubing 303 between the bottom sub 302/hydraulic tubing 303 and the hydraulic housing 322 and interfaces with a second working volume 320 across a shifting sleeve 328. The second working volume 320 in turn interfaces with a second compensating volume 324.

Like the first compensating volume 312 and the first working volume 316, the second compensating volume 324 and the second working volume 320 may be filled with a compressible fluid 326. The compressible fluid in the first compensating volume 312, the first working volume 316, the second compensating volume 324 and the second working volume 320 may be the same fluid or different chambers may contain different fluids. The second working volume 320 is designed to be smaller in size than the first working volume 316.

A shifting sleeve 328 is provided at an interface of the first working volume 316 and the second working volume 320. In certain embodiments, the shifting sleeve 328 may be coupled to a spring 330 which loads the shifting sleeve 328. The shifting sleeve 328 may be moved between a first position in which the shifting sleeve 328 covers and closes a pressure delivery port 334 and a second position in which the shifting sleeve 328 opens the pressure delivery port 334.

One or more hydraulic restrictors 336 may provide an interface between the second working volume 320 and a first side of a second compensating volume 324. The hydraulic restrictors 336 can be used to regulate fluid flow between the second working volume 320 and the second compensating volume 324. A second floating piston 338 is provided at a second side of the second compensating volume 324 such that movement of the second floating piston 338 between a relaxed position and a contracted position can be used to apply pressure to the second compensating volume 324. A second charge port 340 may be provided proximate the second end of the second compensating volume 324 to facilitate delivery of pressure to the second floating piston 338.

The fluid exiting the pressure delivery port 334 passes through a cavity 342 and may be directed through a setting port 344 out of the IHSS 300 and be used to set downhole equipment in a manner similar to that discussed in conjunction with FIG. 1. For instance, the pressure directed through the setting port 344 may be used to drive a hydraulic piston (not shown in FIG. 3) in the same manner discussed in conjunction with FIG. 1 and the hydraulic piston may set downhole equipment. In certain implementations, a fluid reservoir 346 may be provided between the pressure delivery port 334 and the setting port 344 and be used to collect fluids and push fluids through the setting port 344.

Accordingly, the IHSS 300 includes a first working volume 316 and a second working volume 320 positioned on opposing ends thereof and separated by a shifting sleeve 328 that covers a pressure delivery port 334. The first working volume 316 may be filled and pressurized by a first compensating volume 312. Fluid flow between the first compensating volume 312 and the first working volume 316 may be regulated by hydraulic control devices 315. The first compensating volume 312 may operate in the same manner as the compensating volume 112 discussed in conjunction with FIG. 1 above. Specifically, the first compensating volume 312 may be selectively pressurized by moving the first floating piston 310 from a first position to a contracted position in response to annular pressure (or pressure through the tubing) applied by a rig pump or other suitable means (e.g., circulation of fluids having differing weights).

Similarly, the second working volume 320 may be filled and pressurized by a second compensating volume 324. Fluid flow between the second compensating volume 324 and the second working volume 320 may be regulated by hydraulic control devices 336. The second compensating volume 324 may operate in the same manner as the compensating volume 112 discussed in conjunction with FIG. 1 above. Specifically, the second compensating volume 324 may be selectively pressurized by moving the second floating piston 338 from a first position to a contracted position in response to annular pressure (or pressure through the tubing) applied by a rig pump or other suitable means (e.g., fluid having differing weights). The hydraulic control devices 336 associated with the second compensating volume 324 may be adjusted so that the second compensating volume 324 has a different bleed rate than the first compensating volume 312.

The first working volume 316 and the second working volume 320 may be different in size. In the illustrative embodiment of FIG. 3, the first working volume 316 is larger in size than the second working volume 320.

In operation, as pressure is applied (annular pressure or through the tubing or other suitable means), the first compensating volume 312 and the second compensating volume 324 are pressurized by their respective floating pistons 310, 338. Compressible fluid flows from the first compensating volume 312 and the second compensating volume 324 to the first working volume 316 and the second working volume 320, respectively, through the corresponding hydraulic control devices 315, 336 (e.g., check valves and/or hydraulic restrictors). As a result, the first working volume 316 and the second working volume 320 are pressurized.

In the same manner discussed with respect to FIG. 1 above, as the wellbore pressure is reduced, floating pistons 310, 338 associated with the first compensating volume 312 and the second compensating volume 324 move from their contracted position to a relaxed position. Accordingly, the pressure of the first compensating volume 312 and the second compensating volume 324 will be reduced. Consequently, the hydraulic control devices 315 controlling fluid flow between the first compensating volume 312 and the first working volume 316 as well as the hydraulic control devices 336 controlling fluid flow between the second compensating volume 324 and the second working volume 320 seat and seal in the respective pressures of the first working volume 316 and the second working volume 320.

In certain implementations, the hydraulic restrictors 315, 336 may include one or more restrictors. The restrictors associated with the second working volume 320 and the restrictors associated with the first working volume 316 bleed pressure. Due to the difference in size of the first working volume 316 and the second working volume 320, the pressure bleed has a larger impact on the second working volume 320 than the first working volume 316. This difference creates a pressure differential across the shifting sleeve 328. Once the pressure differential across the shifting sleeve 328 is large enough, the shifting sleeve 328 shifts towards the second working volume 320 and opens the pressure delivery port 334 from the first working volume 316 to the downhole equipment to be manipulated. This stored pressure may then be ported by any suitable means known to those of ordinary skill in the art, having the benefit of the present disclosure, to a hydraulic piston that can be used to manipulate downhole equipment.

Figure 4:
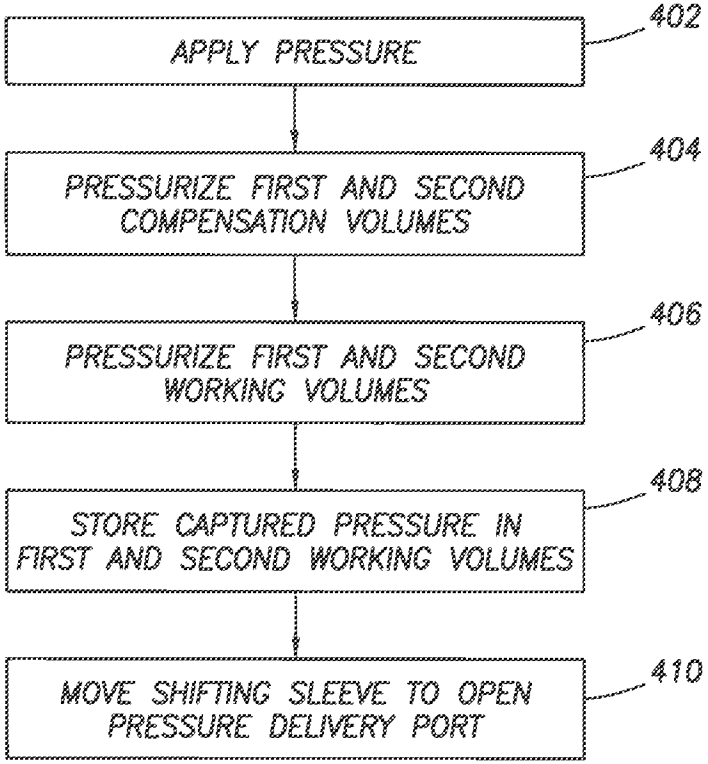
FIG. 4 depicts illustrative method steps associated with a setting cycle using the IHSS of FIG. 3.

FIG. 4 depicts illustrative method steps that may be used to manipulate downhole equipment using the IHSS 300. Although a number of steps are depicted in FIG. 4, as would be appreciated by those of ordinary skill in the art, having the benefit of the present disclosure, one or more of the recited steps may be eliminated or modified without departing from the scope of the present disclosure.

First at step 402, pressure is applied to a closed volume in a wellbore. The pressure may be applied through the hydraulic tubing 303 or through the annulus 305 between the hydraulic tubing 303 and a casing or the wellbore if the wellbore is not cased. The applied pressure acts on the floating pistons 310, 338 of the first compensating volume 312 and the second compensating volume 324 increasing the pressure in the compensating volumes.

Next, at step 406, the working volumes 316, 320 are pressurized. Specifically, the first compensating volume 312 and the second compensating volume 324 are fluidically coupled to the first working volume 316 and the second working volume 320 through hydraulic control devices 315, 336, respectively. As a result, with the increase in the pressure of the first compensating volume 312 and the second compensating volume 324 compressible fluid may flow through the hydraulic control devices 315, 336, to the first working volume 316 and the second working volume 320, respectively. At this point, the system (including the tubing/annular pressure, the compensating volumes 312, 324, and the working volumes 316, 320) is pressure balanced.

At step 408, captured pressure is stored in the first working volume 316 and the second working volume 320. Specifically, as the rig pump pressure is reduced, the floating pistons 310, 338 respond to the pressure difference acting across them and return from their contracted positions to their relaxed positions. As a result, the first compensating volume 312 and the second compensating volume 324 return to a relaxed state. This results in the induction of a pressure difference between the working volumes 316, 320 and their corresponding compensating volumes 312, 324, respectively. Specifically, the induced differential pressure across the compensating volumes 312, 324 and their corresponding working volumes 316, 320, respectively, causes the hydraulic control devices 315, 336 to go on seat and substantially instantaneously seal the first working volume 316 and the second working volume 320 from the first compensating volume 312 and the second compensating volume 324, respectively. As a result, the working volumes 316, 320 remain pressurized and store the captured pressure. By this point, no pressure has been applied to hydraulic piston or any downhole equipment. Accordingly, the IHSS 300 provides a true pressure delay feature where the application of pressure to downhole equipment is not necessarily simultaneous with changes of annular pressure (or pressure through the tubing).

As shown in FIG. 3, the second working volume 320 is smaller than the first working volume 316. The difference in rate at which the first working volume 316 and the second working volume 320 bleed pressure controls the time delay of the pressure delivered to the downhole equipment. Specifically, this difference in rates controls the time it takes to create a pressure differential that is large enough to move the shifting sleeve 328 and port the pressure of the first working volume 316. Accordingly, once the pressure differential between the two ends of the shifting sleeve 328 is large enough, the shifting sleeve 328 moves and exposes the pressure delivery port 334 which facilitates application of pressure to desired downhole equipment from the first working volume 316.

The IHSS 100 and the IHSS 300 provide different implementations of the methods and systems disclosed herein. Specifically, the IHSS 100 delivers its pressure as the applied pressure (annular pressure or tubing pressure) begins to fall and a differential pressure is created between the applied pressure and IHSS 100. In contrast, the application of pressure by the IHSS 300 to the downhole equipment is not dependent upon the applied pressure (annular pressure or tubing pressure) in real-time. Specifically, the IHSS 300 may apply pressure to downhole equipment as long as the wellbore pressure is at a pressure that is below the stored pressure of the IHSS 300. Stated otherwise, in certain implementations the hydraulic control devices 315, 336 may include one or more hydraulic restrictors. As long as there is sufficient pressure differential to allow the hydraulic restrictors to bleed and create a pressure differential across the shifting sleeve 328, the IHSS 300 may deliver pressure to downhole equipment.

Accordingly, any downhole equipment will develop a working load as the rig pump pressure is bled and the working load may be applied to downhole equipment. For instance, the differential pressure may drive a hydraulic piston that sets downhole equipment. The pressure differential that is applied to the hydraulic piston may be contingent upon the wellbore pressure, the bleed rate of wellbore pressure, and the bleed rate of the working volumes 316, 320. For instance, if the dissipation of rig pump pressure resembles a step function, a hammer load is applied to the hydraulic piston to manipulate downhole equipment once the IHSS 300 is fired open. In contrast, if the rig pump pressure is dissipated slowly, the load is delivered more smoothly and may be appropriate for use in setting elastomeric and metal-to-metal packers in the same manner discussed in conjunction with the embodiment of FIG. 1.

Accordingly, the IHSS 300 may be used several times to set or apply force to a device, provided that the first compensating volume 312 and the second compensating volume 324 have a sufficient pre-planned reservoir to allow for multiple actuations. Moreover, the IHSS 300 may reset itself. Specifically, the shifting sleeve 328 may be pushed back into a sealing position over the delivery port by virtue of the spring 330. Properties of the spring 330 may be selected such that the spring 330 can move the shifting sleeve 328 to close the pressure delivery port 334 if the pressure differential between the first working volume 316 and the second working volume 320 falls below a threshold value. Once the pressures of the first working volume 316 and the second working volume 320 are equalized or if the differential pressure is not large enough to move the shifting sleeve 328, the cycle may be repeated to provide setting pressure to further energize downhole equipment. Multiple cycling of the setting spring is further enabled by the fact that there are the hydraulic control devices 315, 336, which may include restrictors that slowly bleed the pressure of the first working volume 316 to the first compensating volume 312 over a duration of time. The restrictors ensure that the energy stored in the working volumes 316, 320 does not remain in the system long term. Consequently, the rig pump may pressure up the hydraulic tubing 303 or the annulus 305 of the well and repeat the setting operation.

As pressure is delivered through the setting port 344, the retained pressure in the first working volume 316 reduces. Once the displacement has been accommodated, additional cycling of the system delivers more pressure and thus, more force, to the hydraulic piston as the displacement of the hydraulic piston in the downhole equipment has been minimized. As a result, a first setting cycle of the IHSS 300 may displace the hydraulic piston with some residual pressure/force in the first working volume 316. A subsequent, second setting cycle may deliver a maximum amount of pressure and force with minimal displacement, ensuring a complete setting of downhole equipment.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. An interventionless hydraulic setting system comprising:

a bottom sub;

a hydraulic tubing extending from the bottom sub;

a communication port housing coupled to the bottom sub, the communication port housing having a charge port;

a compensating volume, wherein the compensating volume is positioned in an annular space between the hydraulic tubing and the communication port housing;

a floating piston located at one side of the compensating volume, wherein fluid flowing through the charge port applies pressure to the floating piston;

a working volume separated from the compensating volume by one or more hydraulic control devices, wherein the one or more hydraulic control devices regulate fluid flow from the compensating volume to the working volume;

wherein application of a pressure to the compensating volume applies a pressure to the working volume;

wherein releasing the pressure applied to the compensating volume creates a differential pressure across the one or more hydraulic control devices;

wherein in response to the creation of the differential pressure the one or more hydraulic control devices substantially seal the working volume from the compensating volume;

wherein the working volume maintains the pressure applied to the working volume when the pressure applied to the compensating volume is released; and a hydraulic piston coupled to the working volume, wherein the hydraulic piston is movable between a first position and a second position using the pressure maintained in the working volume.

2. The system of claim 1, wherein at least one of the compensating volume and the working volume contains a compressible fluid.

3. The system of claim 2, wherein the compressible fluid is a silicone oil.

4. The system of claim 1, wherein the hydraulic piston is operable to set downhole equipment when it moves between the first position and the second position.

5. The system of claim 1, wherein the one or more hydraulic control devices are selected from a group consisting of a check valve, a restrictor, and a combination thereof.

6. An interventionless hydraulic setting system comprising:

a first compensating volume positioned in an annular space between a hydraulic tubing and a communication port housing;

a first working volume positioned in the annular space between the hydraulic tubing and the communication port housing, wherein the first working volume is located adjacent the first compensating volume and separated from the first compensating volume by one or more hydraulic control devices, and wherein a change in pressure of the first compensating volume changes pressure of the first working volume;

a second working volume positioned in the annular space between the hydraulic tubing and the communication port housing, wherein the second working volume is smaller than the first working volume, wherein the second working volume is located between the first working volume and a second compensating volume in an annular space between the hydraulic tubing and the communication port housing, wherein the second working volume is separated from the second compensating volume by one or more hydraulic control devices, and wherein a change in pressure of the second compensating volume changes pressure of the second working volume;

a pressure delivery port, wherein a shifting sleeve is operable to open and close the pressure delivery port in response to a pressure differential between the first working volume and the second working volume, and wherein the pressure delivery port delivers pressure to downhole equipment.

7. The system of claim 6, wherein at least one of the first compensating volume, the second compensating volume, the first working volume, and the second working volume contains a compressible fluid.

8. The system of claim 7, wherein the compressible fluid is a silicone oil.

9. The system of claim 6, wherein a first charge port is operable to deliver pressure to the first compensating volume using a first floating piston and a second charge port is operable to deliver pressure to the second compensating volume using a second floating piston.

10. The system of claim 6, wherein the shifting sleeve is coupled to a spring, wherein the spring moves the shifting sleeve to close the pressure delivery port if the pressure differential between the first working volume and the second working volume is below a threshold value.

11. The system of claim 6, wherein the pressure delivery port delivers pressure to downhole equipment using a hydraulic piston.

12. The system of claim 6, wherein the one or more hydraulic control devices are selected from a group consisting of a check valve, a restrictor, and a combination thereof.

13. A method of setting downhole equipment comprising:

applying a pressure to a compensating volume, providing a working volume, wherein the working volume is separated from the compensating volume by one or more hydraulic control devices;

applying a pressure to the working volume in response to the pressure applied to the compensating volume;

releasing the pressure applied to the compensating volume, wherein releasing the pressure applied to the compensating volume creates a differential pressure across the one or more hydraulic control devices;

substantially sealing the working volume from the compensating volume using the one or more hydraulic control devices in response to creation of the differential pressure;

capturing the pressure applied to the working volume;

wherein capturing the pressure applied to the working volume comprises maintaining the pressure applied to the working volume when the pressure applied to the compensating volume is released; and applying the captured pressure in the working volume to set downhole equipment.

14. The method of claim 13, wherein at least one of the working volume and the compensating volume contains a compressible fluid.

15. The method of claim 14, wherein the compressible fluid is a silicone oil.

16. The method of claim 13, further comprising regulating fluid flow between the compensating volume and the working volume using a hydraulic control device.

17. The method of claim 13, wherein the hydraulic control devices is a device selected from a group consisting of a check valve, a restrictor, and a combination thereof.

18. The method of claim 13, wherein applying a pressure to the compensating volume comprises flowing a fluid through a charge port, wherein the fluid applies a pressure to a floating piston and the floating piston applies pressure to the compensating volume.

19. The method of claim 13, wherein applying the captured pressure in the working volume to set downhole equipment comprises applying the captured pressure to a hydraulic piston.

20. The method of claim 13, wherein at least one of the compensating volume and the working volume is positioned in an annular space between a hydraulic tubing and a communication port housing.

* * * * *